US007393288B2

(12) United States Patent
Egashira et al.

(10) Patent No.: US 7,393,288 B2
(45) Date of Patent: Jul. 1, 2008

(54) GOLF BALL MATERIAL, GOLF BALL AND METHOD FOR PREPARING GOLF BALL MATERIAL

(75) Inventors: Yoshinori Egashira, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 204 days.

(21) Appl. No.: 11/159,305

(22) Filed: Jun. 23, 2005

(65) Prior Publication Data

US 2006/0293121 A1 Dec. 28, 2006

(51) Int. Cl.
*A63B 37/00* (2006.01)

(52) U.S. Cl. ..... 473/351

(58) Field of Classification Search ..... None
See application file for complete search history.

(56) References Cited

U.S. PATENT DOCUMENTS 5,306,760 A 4/1994 Sullivan
5,312,857 A 5/1994 Sullivan
5,681,898 A * 10/1997 Pocklington ..... 525/193
2004/0044136 A1 3/2004 Kim

FOREIGN PATENT DOCUMENTS

WO WO 98/46671 A1 10/1998

* cited by examiner

*Primary Examiner*—Raeann Trimiew
(74) *Attorney, Agent, or Firm*—Sughrue Mion, PLLC

(57) ABSTRACT

A golf ball material composed of (A) an ionomer, (B) a resin composition which includes one or more selected from the group consisting of diene polymers, thermoplastic polymers and thermoset polymers, and (C) an acid group-bearing thermoplastic resin composition is prepared by melt-mixing components B and C so as to form a resin composition of components B and C, then melt-mixing this resin composition with component A while injecting water under pressure. The golf ball material has a good thermal stability, flow and processability, and can be used to produce high-performance golf balls endowed with durability, scuff resistance and optimal hardness without a loss of rebound.

19 Claims, No Drawings

GOLF BALL MATERIAL, GOLF BALL AND METHOD FOR PREPARING GOLF BALL MATERIAL

BACKGROUND OF THE INVENTION

The present invention relates to golf ball materials having heat resistance, flowability and processability, providing high-performance golf balls having excellent properties such as rebound and durability. The invention also relates to golf balls comprising as an essential component therein a molding made from such a golf ball material, and to methods for preparing such golf ball materials.

In recent years, ionomer resins have been widely used as cover materials of golf balls. Ionomer resins are ionic copolymers comprising an olefin such as ethylene and an unsaturated carboxylic acid such as acrylic acid, methacrylic or maleic acid, having some of the acid groups neutralized with metal cations such as sodium, lithium, zinc or magnesium. These resins provide excellent characteristics such as durability, rebound resilience and scuff resistance of the ball.

Today, the base resins used as cover materials of golf balls are mostly ionomer resins, but a variety of modifications are being made to mactch the constant desire by golfers for golf balls having a high rebound resilience and an excellent carry-and-run performance.

For example, to improve the rebound resilience and to reduce the cost of ionomer cover materials, U.S. Pat. No. 5,312,857, U.S. Pat. No. 5,306,760 and International Application WO 98/46671 describe cover materials composed of ionomer resins with a large amount of metallic soap added.

However, the metallic soap in such cover materials undergoes decomposition and vaporization during injection molding, releasing a large amount of fatty acid vapor, easily causing molding defects. The released vapor coagulates to form deposits on the surface of the molding, markedly lowering its paintability. The rebound resilience of these cover materials does not differ to any considerable extent from the rebound resilience of the ionomer covers of the same hardness containing no metallic soap; either the rebound resilience in both cases is almost the same or, at most, only a small positive effect on the rebound resilience is observable from the metallic soap composition.

Such a composition therefore does not markedly improve the rebound resilience. Moreover, depending on the type of metallic soap used, the processability and the rebound resilience are sometimes greatly lost, making the cover material far off the level of practical use.

An ionomer for use as a golf ball material has recently been developed in the form of a high rebound resilience material having an interpenetrating network (IPN) structure and a homogeneous phase. The ionomer is obtained by mixing a first component such as an ethylene-(meth)acrylic acid copolymer with a different type of thermoplastic resin as a second component to form a resin composition, and then adding a metal ionic species as a third component to neutralize the acid groups in the first component melt-mixed in the resin composition (U.S. Patent Application Publication No. 2004/0044136). However, in this prior-art production method, as a metal ionic species such as a metal oxide, metal hydroxide or metal carbonate is used directly in the form of a solid (powder or granular material), particularly in some case of using a large amount of the solid due to a high degree of neutralization, a poor dispersion may arise during the melt-mixing, leaving some of the metal ions unreacted. There is a concern that such unreacted metal ions may deteriorate the physical properties of the ionomer material obtained.

From the viewpoint of the above described, the objects of the invention concerning no direct use of a metal ionic species such as a metal oxide, a metal hydroxide or an acid metal salt are:

1) providing golf ball materials having good properties such as heat resistance, flowability and processability by use of which high-performance golf balls having excellent properties such as durability, scuff resistance and optimal hardness are obtained with a minor sacrifice of rebound resilience,
2) providing golf balls comprising a molding made from such a golf ball material as an essential component,
3) providing a method for preparing such golf ball materials.

SUMMARY OF THE INVENTION

As a result of extensive investigations, it has found out that materials obtained by melt-mixing as the essential components (A) an ionomer, (B) a resin composition having one or more selected from the group consisting of diene polymers, thermoplastic polymers and thermoset polymers, and (C) an acid group content thermoplastic resin composition have surprisingly good properties such as heat resistance, flowability and processability and that these materials are suitable for injection molding, moreover (being) very useful as a golf ball material to produce high-performance golf balls having excellent properties such as durability, scuff resistance and optimal hardness, with a minor loss of the rebound resilience.

It has also found out that golf balls comprising a molding made from such a golf ball material, as described above, used as an essential component of the golf balls exhibit excellent properties such as durability, scuff resistance and optimal hardness with a minor loss of rebound resilience. These findings described above lead to the invention.

"Essential component," as used here, refers to a cover or intermediate layer in a two-piece solid golf ball composed of a core and a cover surrounding the core or in a multi-piece solid golf ball composed of a core of at least one layer, at least one intermediate layer surrounding the core, and a cover of at least one layer surrounding the intermediate layer. The same meaning referred above to essential component applies to the following content below.

Accordingly, the invention provides the following golf ball materials, golf balls, and methods for preparing golf ball materials.

[1] A golf ball material characterized by including a composition having component A, component B and component C used as essential components:

(A) an ionomer, (B) a resin composition including one or more selected from the group consisting of diene polymers, thermoplastic polymers and thermoset polymers, and (C) an acid group content thermoplastic resin composition.

[2] The golf ball material of [1] claimed above, obtained by melt-blending component A into components B and C, wherein metal ionic species present in component A can transfer to and/or interact with at least some acid groups present in a composition of component B and component C.

[3] The golf ball material of [1] claimed above, wherein component B is a resin composition of one or more selected from the group consisting of polyolefin elastomers, polystyrene elastomers, polyacrylate polymers, polyamide elastomers, polyurethane elastomers, polyester elastomers, diene polymers, polyacetals, epoxy resins, unsaturated polyester resins, silicone resins and ABS resins.

[4] The golf ball material of [1] claimed above, wherein the acid groups in component C are at least one type selected from among carboxylic acids, sulfonic acids and phosphoric acids, with an acid content of 0.1 to 30% by weight thereof.

[5] The golf ball material of [1] claimed above, wherein the acid groups in component C are of at least one type selected from among unsaturated carboxylic anhydrides, unsaturated dicarboxylic acid (including dicarboxylic acid half esters) and unsaturated carboxylic acid derivatives, with an acid content of 0.1 to 5% by weight thereof.

[6] The golf ball material of [1] claimed above, wherein component A comprises an acid content base resin having a melt flow rate of 0.1 to 10,000 g/10 min with an acid content of 0.1 to 30% by weight. The acids are selected from among carboxylic acids (including carboxylic anhydrides and carboxylic acid derivatives), sulfonic acids and phosphoric acids. The degree of neutralization is in a range of 5 to 100 mol %, and a metal cation species used as the acid neutralization is selected from among lithium, sodium, potassium, zinc, magnesium, manganese, calcium and copper. The amount of component A used depends on the amount of metal cations which transfer to and/or interact with the acid groups in a composition of components B and C.

[7] The golf ball material of [1] claimed above, wherein component B is a resin composition of one or more selected from the group consisting of diene polymers, polyacetals, epoxy resins, unsaturated polyester resins, silicone resins and ABS resins, with a ratio of 1 to 50% by weight to the combined weight of component A, component B and component C.

[8] The golf ball material of [1] claimed above, wherein component B is a polybutadiene having a cis-1,4 bond content of at least 60%, a 1,2-vinyl bond content of at most 4%, a Mooney viscosity ($ML_{1+4}$ (100° C.)) of 35 to 65, a weight-average molecular weight (Mw) of 450,000 to 850,000, with a Mw/Mn ratio of at most 5.

[9] The golf ball material of [1] above, wherein component B is a polybutadiene that is used itself and/or in a composition of an acid anhydride with a radical crosslinking agent to form a polybutadiene composition. By melt-mixing component A with the composition of component B and component C, followed by melt-mixing component C with a polybutadiene or its composition, is the golf ball material obtained wherein metal cations in component A transfer to and/or interact with acid groups in the resin composition of components B and C.

[10] The golf ball material of [1] claimed above, wherein component B is a polybutadiene and is in a ratio of 1 to 50% by weight to the combined weight of the resin composition of component A, component B and component C.

[11] The golf ball material of [1] claimed above, wherein component B is a polyacetal homopolymer and/or a polyacetal copolymer having an impact strength of 35 to 130 J/m and a flexural modulus of 2.50 to 3.10 GPa.

[12] The golf ball material of [1] claimed above, wherein component B is a polyacetal and is in a ratio of 1 to 50% by weight to the combined weight of the resin composition of component A, component B and component C.

[13] A golf ball characterized by including a molding made from the golf ball material of any preceding claim of [1] to [12] as defined above.

[14] A golf ball characterized by use of the golf ball material of any preceding claim of [1] to [12] as defined above as a cover material in a two-piece solid golf ball composed of a core and a cover surrounding the core, or as a cover material or an intermediate cover material in a multi-piece solid golf ball composed of a core of at least one layer, one or more intermediate layers surrounding the core, and a cover of at least one layer surrounding the intermediate layer.

[15] A method for preparing a golf ball material having a composition of the following essential components A to C:

(A) an ionomer, (B) a resin composition including one or more selected from the group consisting of diene polymers, thermoplastic polymers and thermoset polymers, and (C) an acid group content thermoplastic resin composition;

the method characterized by melt-mixing component B and component C at a temperature over both melting points of components B and C to form a resin composition of components B and C, with which component A then melt-mixes wherein metal cations in component A transfer to and/or interact with at least some of the acid groups present in the resin composition of components B and C.

[16] The method of [15] claimed above, wherein a twin-screw extruder is used to melt-mix components B and C.

[17] The method of [16] claimed above, wherein the twin-screw extruder has a length-to-diameter (LD) ratio of at least 20.

[18] The method of [16] claimed above, wherein the twin-screw extruder has a screw segment configuration having a kneading disc zone in an L/D ratio of 10 to 90% to the overall L/D ratio.

[19] The method of [16] claimed above, wherein the kneading disc zone of the twin-screw extruder consist of right-handed kneading discs, left-handed kneading discs, reverse discs, and various neutral discs.

[20] The method of [16] claimed above, wherein the twin-screw extruder has a screw diameter of at least 15 mm.

[21] The method of [16] claimed above, wherein the twin-screw extruder has a vent port with a vacuum line connected thereto.

[22] The method of [16] claimed above, wherein the twin-screw extruder is equipped with a liquid-dropping apparatus or a pressurized liquid injection pump.

[23] The method of [16] claimed above, wherein the liquid is a chemical shown by the formula ROH, where R is hydrogen or an alkyl group, and is added in an amount of 0.1 to 10% by weight versus the resin extrusion output.

[24] A two-piece golf ball including a core composed of a butadiene rubber-based rubber material and a cover, wherein the cover is a molding made by injection molding a golf ball material prepared by the method of any preceding claim of [15] to [23] above.

DETAILED DESCRIPTION OF THE INVENTION

The inventive method of manufacturing golf balls is described more fully below.

The golf ball material of the invention is a blend of the following essential components A to C: (A) an ionomer, (B) a resin composition which includes one or more selected from the group consisting of diene polymers, thermoplastic polymers and thermoset polymers, and (C) an acid group-bearing thermoplastic resin composition.

Component A is an ionomer composed of an acid-containing base resin which has a melt flow rate of generally 0.1 to 10,000 g/10 min, preferably 5 to 5,000 g/10 min, and which is selected from the group consisting of oligomers, prepolymers and polymers, wherein the acid is selected from among carboxylic acids (including carboxylic anhydrides and carboxylic acid derivatives), dicarboxylic acids (including, here and below, dicarboxylic acid half esters), sulfonic acids and phosphoric acids and is present in an amount of 0.1 to 30 wt %, and preferably 0.5 to 25 wt %.

The acid groups on the base resin of the ionomer used as component A are not subject to any particular limitation. Exemplary acids include carboxylic acids, sulfonic acids and phosphoric acids. Of these, carboxylic acids are preferred. Preferred carboxylic acids are unsaturated carboxylic acids and unsaturated dicarboxylic acids. Specific examples include acrylic acid, methacrylic acid and ethacrylic acid. Acrylic acid and methacrylic acid are especially preferred. Specific examples of unsaturated dicarboxylic acids include maleic acid, fumaric acid and itaconic acid. Specific examples of unsaturated inorganic carboxylic acids include maleic anhydride and itaconic anhydride. Maleic acid and maleic anhydride are especially preferred.

Unsaturated carboxylic acid esters that may be included in above component A are preferably lower alkyl esters of the above-mentioned unsaturated carboxylic acids. Specific examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

Specific examples of unsaturated dicarboxylic acid half esters include the monoethyl ester of maleic acid, the monomethyl ester of fumaric acid and the monoethyl ester of itaconic acid. The monoethyl ester of maleic acid is especially preferred.

From the standpoint of the chemical structure, illustrative examples of the base resin in the ionomer of component A include olefin-unsaturated carboxylic acid polymers; olefin-unsaturated carboxylic acid-unsaturated carboxylic acid ester polymers, unsaturated carboxylic anhydride or unsaturated dicarboxylic acid or unsaturated carboxylic acid-grafted polymers; unsaturated carboxylic anhydride or unsaturated dicarboxylic acid or unsaturated carboxylic acid-grafted olefin-unsaturated carboxylic acid polymers; unsaturated carboxylic anhydride or unsaturated dicarboxylic acid or unsaturated carboxylic acid-grafted olefin-unsaturated carboxylic acid-unsaturated carboxylic acid ester polymers; olefin-unsaturated carboxylic anhydride polymers; olefin-unsaturated carboxylic anhydride-unsaturated carboxylic acid ester polymers; and olefin-unsaturated dicarboxylic acid-unsaturated carboxylic acid ester polymers.

Specific examples of such base resins include ethylene-acrylic acid polymers,
ethylene-methacrylic acid polymers,
ethylene-ethacrylic acid polymers,
ethylene-methacrylic acid-n-butyl acrylate polymers,
ethylene-methacrylic acid-isobutyl acrylate polymers,
maleic anhydride-grafted (abbreviated below as "g") polyethylenes,
maleic anhydride-g-polypropylenes,
maleic anhydride-g-ethylene propylene polymers,
maleic anhydride-g-ethylene propylene diene polymers (EPDM),
maleic anhydride-g-ethylene ethyl acrylate polymers,
maleic anhydride-g-polyethylene terephthalates,
maleic anhydride-g-ethylene-methacrylic acid polymers,
maleic anhydride-g-ethylene-methacrylic acid-isobutyl acrylate polymers,
ethylene-maleic anhydride polymers,
styrene-maleic anhydride polymers,
ethylene-maleic anhydride-ethyl acrylate polymers and
ethylene-maleic acid-ethyl acrylate polymers.

Commercially available base resins for the ionomer of component A include olefin-unsaturated carboxylic acid polymers. Specific examples of commercial products include A-C5120 (a product of Tomen Plastics Corporation), Nucrel 599, Nucrel 699, Nucrel 960 and Nucrel 2806 (all products of Du Pont), Primacor 3460, Primacor 59801 and Primacor 59901 (all products of Dow Chemical), and ESCOR 5000, ESCOR 5100 and ESCOR 5200 (all products of Exxon-Mobil Chemical).

Specific examples of commercial olefin-unsaturated carboxylic acid-unsaturated carboxylic acid ester polymers that may be used include Bynel 2002, Bynel 2014, Bynel 2022 and Bynel E403 (all products of Du Pont), and ESCOR ATX325, ESCOR ATX320 and ESCOR ATX310 (all products of Exxon-Mobil Chemical).

Specific examples of commercial unsaturated carboxylic anhydride-grafted polymers that may be used include Polybond 3009, Polybond 3200 and Royaltough 498 (all products of Uniroyal Chemical), ADOMER NF518 and ADOMER QE800 (both products of Mitsui Chemicals, Inc.), Exxelor VA1801, Exxelor VA1803, Exxelor VA1840 and Exxelor PO1020 (all products of Exxon-Mobil Chemical), and Bynel 2167, Bynel 2174, Bynel 4206, Bynel 4288, Bynel 50E561 and Bynel 50E571 (all products of Du Pont).

Specific examples of unsaturated carboxylic anhydride polymers include MODIPER A8100, MODIPER A8200 and MODIPER A8400 (all products of NOR Corporation), and LOTADER 3200, LOTADER 3300, LOTADER 5500, LOTADER 6200, LOTADER 7500, LOTADER 8200 and LOTADER TX8030 (all products of ATOFINA).

The base resin of the ionomer of component A can also be obtained by using a known process to copolymerize the various above materials.

The ionomer of component A preferably has a good dispersibility when melt-mixed with the resin composition of components B and C. Moreover, because it is preferred that the metal ions in component A be transferable or sharable, it is advantageous for the ionomer which is used to be one having a good balance between its melt flow properties (i.e., melt flow rate, or "MFR") and its degree of neutralization. If an ionomer containing no maleic anhydride or derivatives thereof (i.e., if the base resin of the ionomer contains no maleic anhydride or derivatives thereof) is used, the degree of neutralization with respect to the acid groups present on the base resin is typically 5 to 100 mol %, preferably 10 to 90 mol %, and more preferably 15 to 85 mol %. At a high degree of neutralization, the MFR is too low, making dispersibility during melt mixing very poor. The transfer and sharing of metal ions is thus irregular, as a result of which the golf ball material may be non-uniform. On the other hand, if the degree of neutralization is low, dispersibility during melt mixing is good, but there are fewer metal ions to be transferred and/or shared, which may lower the physical properties of the golf ball material, such as the rebound resilience and toughness.

On the other hand, in the case of ionomers containing maleic anhydride and derivatives thereof (i.e., when the base resin of the ionomer includes maleic anhydride and derivatives thereof), the content of maleic anhydride and its derivatives is generally less than 5 wt %. Hence, even at a high degree of neutralization, there are few intermolecular crosslink sites, and so the ionomer will exhibit flow properties during melt mixing without any particular problems.

In any case, it is preferable to use as the base resin of the ionomer one having a high melt flow rate and a high acid content.

The metal ionic species in the ionomer of component A is selected from among lithium, sodium, potassium, zinc, magnesium, manganese, calcium and copper. The amount of component A included in the golf ball material is suitably selected in accordance with the amount of metal ions capable of being transferred to or shared with the acid groups on the resin composition of components B and C.

The ionomer of component A is an ionomer having any degree of neutralization with respect to the acid groups on the base resin. A typical example would be a material composed of an ethylene-acrylic acid polymer (abbreviated below as "EAA") with a 20 wt % acid group content, of which 55 mol % is neutralized with zinc ions (abbreviated as "55 mol % Zn-EAA"). Or the ionomer may be suitably prepared from the same base resin as, for example, 80 mol % Zn-EAA or 20 mol % Zn-EAA. Alternatively, the ionomer can be an ethylene-methacrylic acid polymer ("EMMA") with a 15 wt % acid group content, of which 77 mol %, for example, may be neutralized with zinc or sodium ions (abbreviated respectively as "77 mol % Zn-EMMA" or "77 mol % Na-EMAA").

Preparation of an ionomer having a desired degree of neutralization can be carried out by a known neutralization reaction between an oxygen-containing metal compound having the metal ion mentioned above and the base resin (acid groups) of the ionomer.

Commercial ionomers that can be used as the ionomer serving as component A include Surlyn S8150, Surlyn S8940, Surlyn S8945, Surlyn S9150, Surlyn S9910 and Surlyn S9945 (all products of Du Pont), and IOTEK 7010, IOTEK 7410, IOTEK 7610, IOTEK 8420 AND IOTEK 8610 (all products of Exxon-Mobil Chemical).

Component B in the invention is a resin composition made up of one or more polymer selected from the group consisting of diene polymers, thermoplastic polymers and thermoset polymers. Specific examples include resin compositions made up of one or more selected from the group consisting of polyolefin elastomers, polystyrene elastomers, polyacrylate polymers, polyamide elastomers, polyurethane elastomers, polyester elastomers, diene polymers, polyacetals, epoxy resins, unsaturated polyester resins, silicone resins and ABS resins.

If above component B is a diene polymer, polybutadiene is especially preferred. The polybutadiene preferably has a cis-1,4 bond content of at least 60%, a 1,2-vinyl bond content of not more than 4%, a Mooney viscosity ($ML_{1+4}$ (100° C.) of 35 to 65, a weight-average molecular weight (Mw) of 450,000 to 850,000, and a weight-average molecular weight (Mw) to number-average molecular weight (Mn) ratio of at most 5. Illustrative examples include polybutadienes prepared using a nickel catalyst and polybutadienes prepared using a lanthanide series catalyst, of which the latter is preferred.

The polybutadiene serving as component B may be used directly as is, or it may be used as a polybutadiene composition obtained by the admixture as needed of an acid anhydride and a radical generator such as a peroxide. It is also possible to knead a mixture of the polybutadiene and component C, thereby enabling the metal ions in component A to be transferred to or shared with acid groups in the composition of components B and C so that ionic crosslinks can be formed. Grafting of the acid anhydride occurs at the same time, enabling a material having a homogeneous phase on account of the covalently bonded crosslinks on the polybutadiene to be obtained.

If the golf ball material is to be used as an injection-molding material, components A and C must serve as the matrix, in which case it is preferable for component B to be included in an amount such that the polybutadiene in component B accounts for 1 to 50 wt %, and preferably 5 to 45 wt %, of the overall resin composition. Also, in a golf ball material obtained by the transfer or sharing of metal ions with the acid groups in a resin composition of components B and C that occurs with the incorporation of component A, even though the polybutadiene of component B has been blended into a matrix of components A and C, the golf ball material is homogeneous and has an excellent thermal resistance.

Above component B is an essential component for improving specific gravity control (to a specific gravity 1.0 or higher), fatigue resistance, dimensional stability, wear resistance, impact resistance, processability and the "feel" of the ball when hit (suitable hardness and flexural modulus). Use may be made of one or more selected from the group consisting of polyacetal homopolymers and polyacetal copolymers.

Polyacetal polymers have a Shore D hardness of more than 80. This high degree of hardness makes them desirable also as a hardness-increasing material. If the polyacetal polymer can be uniformly dispersed in component A and/or component C, it will provide an ionomer golf ball material of a high hardness at an acid content of about 10 to 15 wt %.

The above polyacetal polymer is preferably one having an impact strength (¼-inch notched, at 23° C., ASTM D256) of 35 to 130 J/m, and a flexural modulus (ASTM D790) of 2.50 to 3.10 GPa.

Commercial polyacetal homopolymers that may be used include Tenac 5050 and Tenac 7010 (both available from Asahi Kasei Chemicals Corporation), and Delrin 500P (available from Du Pont). Commercial polyacetal copolymers that may be used include Amilus S731 and Amilus S761 (both available from Toray Industries, Inc.), Duracon M140S (available from Polyplastics Co., Ltd.) and Tenac 7520 (available from Asahi Kasei Chemicals Corporation). Specific examples of comonomers that may be used in polyacetal copolymers include alkylene oxides such as ethylene oxide and 1,3-dioxolane.

Above components A and C must serve as the matrix. It is preferable in this case for component B to be included in an amount such that the polyacetal in component B accounts for 1 to 50 wt %, and preferably 5 to 45 wt %, of the overall resin composition. Too much component B may lower the compatibility of components A and C and may also make the overall composition more brittle, which may greatly compromise the durability.

Component C is an acid group-bearing thermoplastic resin composition that is essential for obtaining a golf ball material in which above component B is uniformly dispersed. That is, when component C is melt-mixed together with component B at a temperature that exceeds the melting points of both component B and component C so as to form a molten resin composition, then above component A is additionally blended therein so that metal ions on component A are transferred to or shared with at least some of the acid groups in the resin composition of components B and C, thereby forming ionic crosslinks between component A and component C, there can be obtained a golf ball material in which component B is more uniformly dispersed.

As noted above, component C is an acid group-bearing thermoplastic resin composition. This component C basically is either the same as the base resin of the ionomer of component A, or is a resin composition of one or more base resins. Specifically, it has a melt flow rate of 0.1 to 10,000 g/10 min, and preferably 5 to 5,000 g/10 min. Examples of the acid groups in component C include carboxylic acids, sulfonic acids and phosphoric acids. Component C contains one or more resin selected from the group consisting of oligomers, prepolymers and polymers having an acid content of 0.1 to 30 wt %, and preferably 0.5 to 25 wt %.

In above component C, when the acid groups are unsaturated carboxylic anhydrides or unsaturated dicarboxylic anhydrides (including dicarboxylic acid half esters), the acid content is preferably at least 0.1 wt %, but less than 5 wt %. When the acid groups are unsaturated carboxylic acids or derivatives thereof, the acid content is preferably 0.1 to 30 wt %, and more preferably 0.5 to 25 wt %.

Component C is blended in a proportion such that the weight ratio of component A to component C (A/C) is generally from 99/1 to 1/99, preferably from 95/5 to 5/95, and more preferably from 90/10 to 10/90. The weight ratio (A+C)/B is generally from 95/5 to 5/95, and preferably from 90/10 to 10/90.

When component B is a resin composition of one or more selected from the group consisting of diene polymers, polyacetals, epoxy resins, unsaturated polyester resins, silicone resins and ABS resins, the weight ratio (A+C)/B is generally from 99/1 to 50/50, and preferably from 95/5 to 55/45.

Examples of the acid groups in component C include carboxylic acids, sulfonic acids and phosphoric acids. Of these, carboxylic acids are preferred. Preferred carboxylic acids include unsaturated carboxylic acids and unsaturated dicarboxylic acids. Specific examples include acrylic acid, methacrylic acid and ethacrylic acid. Acrylic acid and methacrylic acid are especially preferred.

Examples of unsaturated dicarboxylic acids include maleic acid, fumaric acid and itaconic acid. Examples of unsaturated carboxylic anhydrides include maleic anhydride and itaconic anhydride. Maleic acid and maleic anhydride are especially preferred.

Unsaturated dicarboxylic acid half esters can also be used as component C. Examples of such unsaturated dicarboxylic acid half esters include maleic acid monoethyl ester, fumaric acid monomethyl ester and itaconic acid monoethyl ester. The use of maleic acid monoethyl ester is especially preferred.

Preferred unsaturated carboxylic acid esters include the lower alkyl esters of the above-mentioned unsaturated carboxylic acids, specific examples of which include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

From the standpoint of the chemical structure, illustrative examples of component C include olefin-unsaturated carboxylic acid polymers; olefin-unsaturated carboxylic acid-unsaturated carboxylic acid ester polymers; unsaturated carboxylic anhydride or unsaturated dicarboxylic acid or unsaturated carboxylic acid-grafted polymers; unsaturated carboxylic anhydride or unsaturated dicarboxylic acid or unsaturated carboxylic acid-grafted olefin-unsaturated carboxylic acid polymers; unsaturated carboxylic anhydride or unsaturated dicarboxylic acid or unsaturated carboxylic acid-grafted olefin-unsaturated carboxylic acid-unsaturated carboxylic acid ester polymers; olefin-unsaturated carboxylic anhydride polymers; olefin-unsaturated carboxylic anhydride-unsaturated carboxylic acid ester polymers; and olefin-unsaturated dicarboxylic acid-unsaturated carboxylic acid ester polymers.

Specific examples of polymers include ethylene-acrylic acid polymers, ethylene-methacrylic acid polymers, ethylene-ethacrylic acid polymers, ethylene-methacrylic acid-n-butyl acrylate polymers, ethylene-methacrylic acid-isobutyl acrylate polymers, maleic anhydride-grafted (abbreviated below as "g") polyethylenes, maleic anhydride-g-polypropylenes, maleic anhydride-g-ethylene propylene polymers, maleic anhydride-g-ethylene propylene diene polymers (EPDM), maleic anhydride-g-ethylene ethyl acrylate polymers, maleic anhydride-g-polyethylene terephthalates, maleic anhydride-g-ethylene-methacrylic acid polymers, maleic anhydride-g-ethylene-methacrylic acid-isobutyl acrylate polymers, ethylene-maleic anhydride polymers, styrene-maleic anhydride polymers, ethylene-maleic anhydride-ethyl acrylate polymers and ethylene-maleic acid-ethyl acrylate polymers.

A commercially available base resin may be used as component C. Examples of commercial olefin-unsaturated carboxylic acid polymers include A-C540, A-C580 and A-C5120 (products of Tomen Plastics Corporation), Nucrel 599, Nucrel 699, Nucrel 960, Nucrel 1214 and Nucrel 2806 (all products of Du Pont), Nucrel 1560 and Nucrel 2050H (both products of DuPont-Mitsui Polychemicals Co., Ltd.), Primacor 3460, Primacor 59801 and Primacor 59901 (all products of Dow Chemical), and ESCOR 5000, ESCOR 5100 and ESCOR 5200 (all products of Exxon-Mobil Chemical).

Specific examples of commercially available olefin-unsaturated carboxylic acid-unsaturated carboxylic acid ester polymers include AN4311 and AN4318 (both products of DuPont-Mitsui Polychemicals Co., Ltd.), and ESCOR ATX325, ESCOR ATX320 and ESCOR ATX310 (all products of Exxon-Mobil Chemical).

Specific examples of commercially available unsaturated carboxylic anhydride-grafted polymers include Polybond 3009, Polybond 3200 and Royaltough 498 (all products of Uniroyal Chemical), ADOMER NF518 and ADOMER QE800 (both products of Mitsui Chemicals, Inc.), Exxelor VA1801, Exxelor VA1803, Exxelor VA1840 and Exxelor PO1020 (all products of Exxon-Mobil Chemical), and Fusabond MF416D (a product of Du Pont).

Specific examples of commercially available unsaturated carboxylic anhydride polymers include A-CX575A, A-C597A (both products of Tomen Plastics Corporation), MODIPER A8100, MODIPER A8200 and MODIPER A8400 (all products of NOR Corporation), BONDINE TX8390 (a product of ARKEMA), and LOTADER 4210, LOTADER 5500, LOTADER 6200, LOTADER 7500 and LOTADER TX8030 (all products of ATOFINA).

Optional additives may be suitably included as needed in the golf ball material of the invention. Various types of additives can be selected according to the intended use of the material. For example, if the golf ball material of the invention is to be used as a cover material, additives such as pigments, dispersants, antioxidants, ultraviolet absorbers and light stabilizers may be included together with above components A to C. When these additives are included, the amount of addition thereof per 100 parts by weight of components A to C combined is generally at least 0.1 part by weight, and preferably at least 0.5 part by weight, but generally not more than 10 parts by weight, and preferably not more than 4 parts by weight.

The golf ball material of the invention can be obtained by mixing the various above components using, for example, an internal mixer such as a kneading-type twin-screw extruder, a Banbury mixer, a kneader or a Labo Plastomill. The extruder used for preparing the material is preferably a twin-screw extruder. A twin-screw extruder having features (i) to (v) below is especially preferred.

(i) An effective screw length L/D (screw length-to-diameter ratio) of at least 20, preferably at least 25, and more preferably at least 30.

(ii) A screw segment arrangement such that the L/D ratio of the kneading disc zone is 10 to 90%, preferably 20 to 80%, and more preferably 30 to 70%, of the overall L/D.

Also, the discs in the kneading disc zone of the twin-screw extruder include a right-handed kneading disc, a left-handed kneading disc, a reverse disc, and various neutral discs.

(iii) A screw diameter of at least 15 mm.

(iv) Includes a vent port and a vacuum line connected thereto.

(v) Equipped with a device for the dropwise addition or pressurized injection of a liquid.

After above components B and C are melt-mixed to form a molten resin composition, component A is blended into the molten resin composition, and a liquid may also be added (by injection under pressure or by dropwise addition) to promote the transfer of metal ions to, or neutralization by metal ions of, at least some of the acid groups present in the resin composition of components B and C. The liquid in this case is preferably a compound of the formula ROH, where R represents a hydrogen or an alkyl group. The amount of this liquid added, based on the overall resin extrusion rate, is preferably 0.1 to 10 wt %, more preferably 0.5 to 8 wt %, and even more preferably 1.0 to 5.0 wt %.

The heating conditions can be set to, for example, 100 to 250° C. In particular, it is preferable for melt-mixing to be carried out at a temperature which exceeds the melting points of both component B and component C.

Although the mixing method is not subject to any particular limitation, for better dispersion of component A, it is preferable to first thoroughly melt-mix components B and C so as to form a resin composition, then to add and mix in component A. If additives are to be included, it is also possible to add and mix the additives into the composition following the incorporation of component A.

If the material is prepared using a twin-screw extruder having a screw diameter of 32 mm (L/D=41), for example, it is preferable to set the extrusion rate to 5 to 50 kg/h, and more preferably 10 to 40 kg/h.

If a Banbury mixer or a kneader is used, the component B and C melt mixing time is generally set to from 10 seconds to 30 minutes, and preferably from 30 seconds to 20 minutes. The mixing time following the addition of component A is generally set to from 10 seconds to 30 minutes, and preferably from 15 seconds to 25 minutes.

It is preferable to provide the golf ball material of the invention with a melt flow rate (MFR) within a specific range so as to ensure that it has flow properties which are particularly suitable for injection molding and to improve its processability. Hence, the melt flow rate is generally at least 0.1 g/10 min, and preferably at least 0.5 g/10 min, but generally not more than 50 g/10 min, and preferably not more than 30 g/10 min. A melt flow rate which is too large or too small may significantly reduce the processability of the golf ball material.

As used herein, "melt flow rate" refers to a measured value obtained in accordance with JIS-K7210 at a test temperature of 190° C. and a test load of 21.18N (2.16 kgf).

The golf ball material of the invention has, in Fourier transform infrared absorption spectroscopic (FT-IR) measurements, an absorption peak attributable to carbonyl stretching vibrations at 1690 to 1710 $cm^{-1}$ and an absorption peak attributable to the carboxylate anion stretching vibrations of a metal carboxylate at 1530 to 1630 $cm^{-1}$, confirming the presence of ionic crosslinks.

Moldings obtained using the golf ball material of the invention have a Shore D hardness of generally at least 50, and preferably at least 52, but generally not more than 75, and preferably not more than 70. If the Shore D hardness is to high, the "feel" of the ball when hit may diminish significantly. On the other hand, if the Shore D hardness is too low, the rebound of the ball may decrease.

The golf ball material of the invention has a specific gravity of generally at least 0.9, preferably at least 0.92, and more preferably at least 0.94, but generally not more than 1.3, preferably not more than 1.2, and more preferably not more than 1.05.

The golf ball of the invention is a golf ball which includes as an essential component therein a molding made from the inventive golf ball material described above. Moldings made from the above golf ball material may be used as part or all of the golf ball. Examples include the cover of thread-wound golf balls in which the cover has a single-layer structure or a multilayer structure of two or more layers; one-piece golf balls; the solid core or cover of two-piece solid golf balls; and the solid core, intermediate layer or cover of multi-piece solid golf balls such as three-piece solid golf balls. The type of golf ball is not subject to any particular limitation, provided it is a golf ball which includes as an essential component a molding of the inventive golf ball material.

It is particularly advantageous for the golf ball material of the invention to be used as the cover material in a two-piece solid golf ball composed of a core and a cover which encloses the core, or as the cover material or intermediate layer material in a multi-piece solid golf ball composed of a core of at least one layer, at least one intermediate layer which encloses the core, and at least one cover which encloses the intermediate layer.

Two-piece solid golf balls with a butadiene rubber core and a cover injection-molded from the golf ball material prepared by the above-described method were fabricated and evaluated, from which it was found that golf balls having the following performance and effects can be obtained. The results indicated below were obtained by comparing the invention with, as a control, a golf ball in which the cover material was a melt-mixed composition of a metal ionic species-containing ionomer of the same degree of neutralization (equivalent to the resin composition of components A and C) with component B.

a) The cover surface had an excellent uniformity.

b) Excellent scuff resistance.

c) Excellent durability (number of shots).

d) High hardness.

e) Excellent heat resistance.

f) Partially interpenetrating network structure.

EXAMPLES

Examples are given below by way of illustration and not by way of limitation. The twin-screw extruder for neutralization used in the invention had a screw diameter of 32 mm, an overall L/D ratio of 41, and an L/D ratio for the kneading disc zone which was 40% of the overall L/D ratio. Moreover, it had a vacuum vent port and was equipped with a device for injecting water under pressure.

Example 1

A golf ball material formulated as shown in Table 1 was prepared in a twin-screw extruder set to a temperature of 190° C. by first charging a hopper with given amounts of POM and EMAA-1 and melt-mixing the resins at a screw speed of 70 rpm and an extrusion rate of 16 kg/h while removing volatiles through a vacuum vent. The mixture was extruded as a strand from the extruder die, and passed through a cooling water bath. Excess water was removed with an air knife, then the strand was cut into pellets with a pelletizer, giving the melt mixture POM/EMMA-1, which is designated below as Melt Blend α. Next, the resulting Melt Blend α and Ionomer A were dry blended in given amounts, fed to a hopper, and melt-extruded under the above-described extrusion conditions for Melt Blend α while using a pump for the pressurized injection of a liquid to inject water in an amount of 2 wt %, based on the resin extrusion rate, at an intermediate point along the twin-screw extruder, thereby giving the homogeneous mixed composition POM/EMAA-1/Ionomer A, which is designated below as Melt Blend 1. The properties of the resulting golf ball material were evaluated. The results are shown in Table 1.

Example 2

The Melt Blend 1 obtained in Example 1 and S8940 were dry blended in the amounts shown in Table 1, then melt-extruded under the same extrusion conditions as for Melt Blend α prepared in Example 1, thereby giving the homogeneous mixed composition Melt Blend 1/S8940, which is designated below as Melt Blend 2. The properties of the resulting golf ball material were evaluated. The results are shown in Table 1.

Example 3

POM and EMMA-2 were dry-blended in the proportions indicated in Table 1, then melt-mixed under the same extrusion conditions as for Melt Blend α prepared in Example 1, thereby giving the melt mixture POM/EMMA-2, which is designed below as Melt Blend β. Next, the resulting Melt Blend β and Ionomer B were dry blended in given amounts, then melt-extruded under the same extrusion conditions as for Melt Blend 1 prepared in Example 1, thereby giving the homogeneous mixed composition Melt Blend β/Ionomer B, which is designated below as Melt Blend 3. The properties of the resulting golf ball material were evaluated. The results are shown in Table 1.

Example 4

POM and E·EA·MAH were dry-blended in the proportions indicated in Table 1, then melt-mixed under the same extrusion conditions as for Melt Blend a prepared in Example 1, thereby giving the melt mixture POM/E·EA·MAH, which is designated below as Melt Blend γ. Next, the resulting Melt Blend γ and S8945 were dry blended in given amounts, then melt-extruded under the same extrusion conditions as for Melt Blend 1 prepared in Example 1, thereby giving the homogeneous mixed composition Melt Blend γ/S8945, which is designated below as Melt Blend 4. The properties of the resulting golf ball material were evaluated. The results are shown in Table 1.

Comparative Example 1

Instead of melt-blending a POM-containing EMAA-1 component with an Ionomer A component as in Example 1, an Ionomer C corresponding to an already prepared melt mixture of EMAA-1 with Ionomer A was used. Next, POM and Ionomer C were dry blended in given amounts, then melt-extruded under the same extrusion conditions as for Melt Blend α prepared in Example 1, thereby giving the mixed composition POM/Ionomer C, which is designated below as Melt Blend 1*. The properties of the resulting golf ball material were evaluated. The results are shown in Table 1.

Comparative Example 2

Instead of melt-blending Melt Blend 1 and S8940 as in Example 2, the Melt Blend 1* prepared in Comparative Example 1 and S8940 were melt-extruded under the same extrusion conditions as for Melt Blend α prepared in Example 1, thereby giving the mixed composition POM/S8940, which is designated below as Melt Blend 2*. The properties of the resulting golf ball material were evaluated. The results are shown in Table 1.

Comparative Example 3

Instead of melt-mixing a POM-containing EMAA-2 component with an Ionomer B component as in Example 3, an Ionomer D corresponding to an already prepared melt mixture of EMAA-2 with Ionomer B was used. Next, POM and Ionomer D were dry blended in given amounts, then melt-extruded under the same extrusion conditions as for Melt Blend α prepared in Example 1, thereby giving the mixed composition POM/Ionomer D, which is designated below as Melt Blend 3*. The properties of the resulting golf ball material were evaluated. The results are shown in Table 1.

Comparative Example 4

Instead of melt-mixing a POM-containing E·EA·MAH component with an S8945 component as in Example 4, a Melt Blend ω corresponding to an already prepared melt mixture obtained by melt-mixing the E·EA·MAH component and the S8945 component under the same extrusion conditions as for Melt Blend α prepared in Example 1 was used. Next, POM and Melt Blend ω were dry blended in given amounts, then melt-extruded under the same extrusion conditions as for Melt Blend α prepared in Example 1, thereby giving the mixed composition POM/Melt Blend ω, which is designated below as Melt Blend 4*. The properties of the resulting golf ball material were evaluated. The results are shown in Table 1.

TABLE 1

| | EX 1 Melt Blend 1 | EX 2 Melt Blend 2 | EX 3 Melt Blend 3 | EX 4 Melt Blend 4 | CE 1 Melt Blend 1* | CE 2 Melt Blend 2* | CE 3 Melt Blend 3* | CE 4 Melt Blend 4* |
|---|---|---|---|---|---|---|---|---|
| POM | $10_{(2nd)}$ | $10_{(2nd)}$ | $10_{(2nd)}$ | $10_{(2nd)}$ | $10_{(2nd)}$ | $10_{(2nd)}$ | $10_{(2nd)}$ | $10_{(3rd)}$ |
| E · EA · MAH | — | — | — | $20_{(1st)}$ | — | — | — | $20_{(1st)}$ |
| EMAA-1 | $20_{(1st)}$ | $20_{(1st)}$ | — | — | — | — | — | — |
| Ionomer A | $70_{(3rd)}$ | $70_{(3rd)}$ | — | — | — | — | — | — |
| Ionomer C | — | — | — | — | $90_{(1st)}$ | $90_{(1st)}$ | — | — |
| EMAA-2 | — | — | $30_{(1st)}$ | — | — | — | — | — |
| Ionomer B | — | — | $60_{(3rd)}$ | — | — | — | — | — |
| Ionomer D | — | — | — | — | — | — | $90_{(1st)}$ | — |
| S8945 | — | — | — | $70_{(3rd)}$ | — | — | — | $70_{(2nd)}$ |
| S8940 | — | $100_{(4th)}$ | — | — | — | $100_{(3rd)}$ | — | — |
| MFR (g/10 min) | 2.3 | 3.1 | 28.7 | 3.4 | 1.8 | 2.1 | 26.5 | 3.0 |
| Hardness (Shore D) | 66 | 66 | 65 | 62 | 64 | 65 | 64 | 60 |

TABLE 1-continued

| | EX 1 Melt Blend 1 | EX 2 Melt Blend 2 | EX 3 Melt Blend 3 | EX 4 Melt Blend 4 | CE 1 Melt Blend 1* | CE 2 Melt Blend 2* | CE 3 Melt Blend 3* | CE 4 Melt Blend 4* |
|---|---|---|---|---|---|---|---|---|
| UTS (MPa) | 28.1 | 33.2 | 19.3 | 21.4 | 27.5 | 31.8 | 18.5 | 20.5 |
| UTE (%) | 302 | 339 | 159 | 352 | 314 | 386 | 174 | 364 |
| Remarks | Homogeneous translucent or transparent phase | | | | Heterogeneous translucent or opaque phase | | | |

Amounts of components are given in parts by weight.
Numbers in parentheses ( ) indicate the order in which components were incorporated.

The golf ball materials obtained in Examples 1 to 4 tended to have a higher melt flow rate when a linear polymer such as POM is included than did the golf ball materials obtained in the respective corresponding comparative examples, and so had a better injection moldability than simple melt blends. Moreover, the mixed compositions obtained in the examples of the invention had a better uniformity than those obtained in the comparative examples.

The ingredients shown in Table 1 are described below.

POM: AMILUS S761, produced by Toray Corporation. MFR, 9.6 g/10 min; melting point, 166° C.; Rockwell hardness, R115.

E·EA·MAH: LOTADER TX8030, produced by ATOFINA. MFR, 3.0 g/10 min; comonomer content, 15 wt %.

EMAA-1: Nucrel 1560, an ethylene-methacrylic acid copolymer produced by DuPont-Mitsui Polychemicals Co., Ltd. MFR, 60 g/10 min.

EMAA-2: Nucrel 2050H, an ethylene-methacrylic acid copolymer produced by DuPont-Mitsui Polychemicals Co., Ltd. MFR, 500 g/10 min.

Ionomer A: 77 mol % Zn-EMMA-1, a zinc-neutralized ionomer of ethylene-methacrylic acid copolymer, test-produced by Bridgestone Sports Co., Ltd. Degree of neutralization, 77 mol %; MFR, 0.1 g/10 min.

Ionomer B: 52.5 mol % Zn-EMMA-2, a zinc-neutralized ionomer of ethylene-methacrylic acid copolymer, test-produced by Bridgestone Sports Co., Ltd. Degree of neutralization, 52.5 mol %; MFR, 0.8 g/10 min.

Ionomer C: 60 mol % Zn-EMMA-1, a zinc-neutralized ionomer of ethylene-methacrylic acid copolymer, test-produced by Bridgestone Sports Co., Ltd. Degree of neutralization, 60 mol %; MFR, 0.9 g/10 min.

Ionomer D: 35 mol % Zn-EMMA-2, a zinc-neutralized ionomer of ethylene-methacrylic acid copolymer, test-produced by Bridgestone Sports Co., Ltd. Degree of neutralization, 35 mol %; MFR, 5.0 g/10 min.

S8945: A sodium-neutralized ionomer of ethylene-methacrylic acid copolymer, produced by DuPont. Degree of neutralization, 60 mol %. MFR, 5.0 g/10 min.

S8940: A sodium-neutralized ionomer of ethylene-methacrylic acid copolymer, produced by DuPont. Degree of neutralization, 30 mol %. MFR, 3.0 g/10 min.

MFR (g/10 min): The melt flow rate was measured in accordance with JIS-K7210 at a test temperature of 190° C. and a test load of 21.18 N (2.16 kgf).

Shore D Hardness: Measured in accordance with ASTM D-2240.

Elongation at Break (%) and Tensile Strength (MPa): Measured in accordance with JIS-K7161.

Examples 5 and 6

Using Melt Blend 1 from Example 1 and Melt Blend 2 from Example 2 as the respective cover materials for a two-piece golf ball, using a crosslinked butadiene rubber body (diameter, 38.9 mm; weight, 36.0 g; compression strain, 3.35 mm) as the core, and using an injection molding machine (temperature settings: hopper, 160° C.; C1 to head, 180 to 200° C.), the cover material was injection molded over the core at a molding pressure of 5.9 MPa, a dwell pressure of 4.9 MPa, an injection and dwell time of 8 seconds, and a cooling time of 25 seconds, thereby producing two-piece golf balls (diameter, 42.7 mm; weight, 45.5 g). These golf balls were then evaluated. The results are shown in Table 2.

Comparative Examples 5 and 6

These comparative examples correspond respectively to above Examples 5 and 6. Using Melt Blend 1* from Comparative Example 1 and Melt Blend 2* from Comparative Example 2 as the respective cover materials, two-piece golf balls were produced under the same injection molding conditions as in Examples 5 and 6. These golf balls were then evaluated. The results are shown in Table 2.

TABLE 2

| Golf ball cover material | | Example 5 Melt Blend 1 | Example 6 Melt Blend 2 | Comparative Example 5 Melt Blend 1* | Comparative Example 6 Melt Blend 2* |
|---|---|---|---|---|---|
| Compressive Strain (μ), 23° C. | | 2.70 | 2.71 | 2.80 | 2.74 |
| GB Facial Hardness | | 70 | 70 | 70 | 70 |
| Initial Velocity (m/sec) | 0° | 76.1 | 76.3 | 76.0 | 76.2 |
| | 23° | 76.8 | 77.4 | 76.8 | 77.3 |
| | 40° | 76.6 | 77.2 | 76.5 | 77.2 |
| Average C.O.R. | | 0.774 | 0.791 | 0.770 | 0.790 |
| Shot Number (Durability) | | 84 | 101 | 79 | 88 |
| Shear-cut Resistance, 23° C. | | good | good | normal | normal |
| Abrasion Resistance (Sand) | | good | good | normal | good |
| Heat Resistance (within injection molding machine cylinder; temp. setting, 210° C.; resin residence time, 10 min.) | | no discoloration | no discoloration | turned brown | turned brown |

On comparing Example 5 with Comparative Example 5 and Example 6 with Comparative Example 6, the examples according to the invention had better durability (number of shots), shear-cut resistance, and heat resistance during injection molding.

Example 7

Three kilograms of the high-cis polybutadiene composition BR02 and EMAA-2 were charged, in the proportions shown in Table 3, into a 5-liter pressure kneader and mixed for 20 minutes at a temperature setting of 80° C., a rotor speed of 35 rpm and a pressure of 0.49 MPa. The resulting mixture was then removed from the kneader, extruded with a twin-screw/single-screw extruder (40 mm diameter) at a temperature setting of 130° C., and pelletized. The resulting BR02/EMAA-2 mixture pellets and Ionomer B were dry-blended in given amounts. Aside from changing the twin-screw extruder temperature setting to 180° C., the resulting blend was melt-extruded with a twin-screw extruder under the same extrusion conditions as the Melt Blend 1 prepared in Example 1, thereby giving the homogeneous mixed composition BR02/EMAA-2/Ionomer B, which is designated below as Melt Blend 5. The properties of the resulting golf ball material were evaluated. The results are shown in Table 3.

Example 8

Aside from increasing the amount of BR02 included as shown in Table 3, the operations in Example 7 were repeated, giving the homogeneous mixed composition BR02/EMAA-2/Ionomer B, which is designated below as Melt Blend 6. The properties of the resulting golf ball material were evaluated. The results are shown in Table 3.

Example 9

Aside from dry-blending the Melt Blend 5 obtained in Example 7 with S8150 in given amounts and changing the temperature setting to 180° C., melt-extrusion was carried out under the same conditions as for Melt Blend α prepared in Example 1, thereby giving the homogeneous mixed composition Melt Blend 5/S8150, which is designated below as Melt Blend 7. The properties of the resulting golf ball material were evaluated. The results are shown in Table 3.

Example 10

Aside from using BR01 instead of BR02, the operations in Example 7 were repeated, giving the homogeneous mixed composition BR01/EMAA-2/Ionomer B, which is designated below as Melt Blend 8. The properties of the resulting golf ball material were evaluated. The results are shown in Table 3.

Example 11

Aside from using Melt Blend 8 instead of Melt Blend 5, and dry-blending Melt Blend 8 with S8150 in given amounts, the operations in Example 9 were repeated, giving the homogeneous mixed composition Melt Blend 8/S8150, which is designated below as Melt Blend 9. The properties of the resulting golf ball material were evaluated. The results are shown in Table 3.

Comparative Example 7

Instead of melt-blending a BR02-containing EMAA-2 component with an Ionomer B component as in Example 7, a corresponding Ionomer D obtained by melt-mixing EMAA-2 with Ionomer B was used. Using given amounts of BR02 and Ionomer D, the operations involving the pressure kneader and the twin-screw/single-screw extruder of Example 7 were repeated, thereby giving the mixed composition BR02/Ionomer D, which is designated below as Melt Blend 5*. The properties of the resulting golf ball material were evaluated. The results are shown in Table 3.

Comparative Example 8

Aside from changing the proportions of BR02 and Ionomer D, the operations in Comparative Example 7 were repeated, giving a Melt Blend 6*. The properties of the resulting golf ball material were evaluated. The results are shown in Table 3.

Comparative Example 9

Aside from using Melt Blend 5* instead of Melt Blend 5, and dry-blending Melt Blend * with S8150 in given amounts, the operations in Example 9 were repeated, giving the mixed composition Melt Blend 5*/S8150, which is designated below as Melt Blend 7*. The properties of the resulting golf ball material were evaluated. The results are shown in Table 3.

Comparative Example 10

Aside from using BR01 instead of BR02, the operations in Comparative Example 7 were repeated, giving the mixed composition BR01/Ionomer D, which is designated below as Melt Blend 8*. The properties of the resulting golf ball material were evaluated. The results are shown in Table 3.

Comparative Example 11

Aside from using Melt Blend 8* instead of Melt Blend 7*, the operations in Comparative Example 9 were repeated, giving the mixed composition Melt Blend 8*/S8150, which is designated below as Melt Blend 9*. The properties of the resulting golf ball material were evaluated. The results are shown in Table 3.

TABLE 3

| | EX 7 Melt Blend 5 | EX 8 Melt Blend 6 | EX 9 Melt Blend 7 | EX 10 Melt Blend 8 | EX 11 Melt Blend 9 | CE 7 Melt Blend 5* | CE 8 Melt Blend 6* | CE 9 Melt Blend 7* | CE 10 Melt Blend 8* | CE 11 Melt Blend 9* |
|---|---|---|---|---|---|---|---|---|---|---|
| BR01 | — | — | — | $10_{(2nd)}$ | $10_{(2nd)}$ | — | — | — | $10_{(2nd)}$ | $10_{(2nd)}$ |
| BR02 | $10_{(2nd)}$ | $20_{(2nd)}$ | $10_{(2nd)}$ | — | — | $10_{(2nd)}$ | $20_{(2nd)}$ | $10_{(2nd)}$ | — | — |
| EMAA-2 | $30_{(1st)}$ | $26.7_{(1st)}$ | $30_{(1st)}$ | $30_{(1st)}$ | $30_{(1st)}$ | — | — | — | — | — |
| Ionomer B | $60_{(3rd)}$ | $53.3_{(3rd)}$ | $60_{(3rd)}$ | $60_{(3rd)}$ | $60_{(3rd)}$ | — | — | — | — | — |
| Ionomer D | — | — | — | — | — | $90_{(1st)}$ | $80_{(1st)}$ | $90_{(1st)}$ | $90_{(1st)}$ | $90_{(1st)}$ |
| S8150 | — | — | $100_{(4th)}$ | — | $100_{(4th)}$ | — | — | $100_{(3rd)}$ | — | $100_{(3rd)}$ |
| MFR (g/10 min) | 9.2 | 1.9 | 7.9 | 20.4 | 8.0 | 20.1 | 5.5 | 9.8 | 170 | 9.4 |
| Hardness (Shore D) | 54 | 52 | 61 | 52 | 59 | 41–52 | 48 | 59–61 | 40 | 59 |
| UTS (MPa) | 18.8 | 18.5 | 27.4 | 17.3 | 26.6 | broke | broke | 23.8 | 11.2 | 28.1 |

TABLE 3-continued

| | EX 7 Melt Blend 5 | EX 8 Melt Blend 6 | EX 9 Melt Blend 7 | EX 10 Melt Blend 8 | EX 11 Melt Blend 9 | CE 7 Melt Blend 5* | CE 8 Melt Blend 6* | CE 9 Melt Blend 7* | CE 10 Melt Blend 8* | CE 11 Melt Blend 9* |
|---|---|---|---|---|---|---|---|---|---|---|
| UTE (%) | 234 | 218 | 273 | 157 | 269 | broke | broke | 13 | 248 | 286 |
| Remarks | Homogeneous phase | | | | | Heterogeneous phase | | | | |

Amounts of components are given in parts by weight.
Numbers in parentheses ( ) indicate the order in which components were incorporated.

On comparing the results from Examples 7 to 11 with those for the corresponding Comparative Examples 7 to 11, in the examples according to the invention, the mixed compositions were more homogeneous phases, had a high strength at break and were thus tough, and tended to have a higher hardness. In addition, when a non-linear polymer such as butadiene rubber was included, the melt flow rate tended to be lower.

The ingredients in Table 3 are described below.

BR01: The polybutadiene BR01 produced by JSR Corporation; cis-1,4 bond content, 96%; nickel polymerization catalyst.

BR02: A product prepared by mixing 2 parts by weight of maleic anhydride with 100 parts by weight of BR01, then adding 1 part by weight of dicumyl peroxide per 100 parts by weight of the resulting mixture and mixing at about 80° C. for 10 minutes.

S8150: A sodium-neutralized ionomer of ethylene-methacrylic acid copolymer, produced by DuPont. Degree of neutralization, 37 mol %. MFR, 5.0 g/10 min.

Example 12

Aside from using Melt Blend 5 from Example 7 instead of Melt Blend 1 from Example 5 as the cover material for a two-piece golf ball, the operations in Example 5 were repeated to produce a two-piece golf ball. The golf ball was then evaluated. The results are shown in Table 4.

Comparative Example 12

This comparative example corresponds with above Example 12. Aside from using Melt Blend 5* from Comparative Example 7 as the cover material for a two-piece golf ball, a two-piece golf ball was fabricated under the same injection molding conditions as in Example 12. The golf ball was then evaluated. The results are shown in Table 4.

TABLE 4

| | Example 12 | Comparative Example 12 |
|---|---|---|
| Golf Ball Cover Material | Melt Blend 5 | Melt Blend 5* |
| Golf ball diameter (mm) | 42.7 | 42.7 |
| Golf ball weight (g) | 45.3 | 45.4 |
| Compressive Strain (μ), 23° C. | 2.89 | 2.45 |
| GB Facial Hardness | 63 | 58 |
| Initial Velocity (m/sec) 0° | 76.47 | 76.29 |
| 23° | 76.47 | 76.41 |
| 40° | 75.79 | 75.76 |
| Average C.O.R. | 0.768 | 0.766 |
| Shot Number (Durability) | 85 | 21 |
| Back Spin (rpm) X-Drive #W1 | 2599 | 2581 |
| S/W TW03 | 5686 | 5690 |
| Shear-cut Resistance, 23° C. | Good | Poor |

TABLE 4-continued

| | Example 12 | Comparative Example 12 |
|---|---|---|
| Remarks | Good heat resistance (210° C., 30 min: no discoloration) Poor durability Poor uniformity | Poor heat resistance (210° C., 30 min: turned brown) Poor durability Poor uniformity |

In Example 12, compared with Comparative Example 12, there was no loss of initial velocity or coefficient of restitution (C.O.R.), the durability (number of shots) was good, and the durability was somewhat higher. Moreover, because the compressive strain was high, the ball demonstrated a soft "feel" when hit. In addition, during injection molding, although the cylinder temperature was set to 210° C. and the residence time of material within the cylinder was 30 minutes, no resin scorching occurred, indicating a good heat resistance.

The invention claimed is:

1. A golf ball material characterized by including a composition having component A, component B and component C used as essential components:

(A) an ionomer, (B) a resin composition including one or more selected from the group consisting of diene polymers, thermoplastic polymers and thermoset polymers, and (C) an acid group content thermoplastic resin composition, wherein component B is a polybutadiene having a cis-1,4 bond content of at least 60%, a 1,2-vinyl bond content of at most 4%, a Mooney viscosity ($ML_{1+4}$ (100° C.)) of 35 to 65, a weight-average molecular weight (Mw) of 450,000 to 850,000, with a Mw/Mn ratio of at most 5.

2. The golf ball material of claim 1 which is obtained by melt-blending component A into components B and C, wherein metal ionic species present in component A can transfer to and/or interact with at least some acid groups present in a composition of component B and component C.

3. The golf ball material of claim 1, wherein the acid groups in component C are at least one type selected from among carboxylic acids, sulfonic acids and phosphoric acids, with an acid content of 0.1 to 30% by weight thereof.

4. The golf ball material of claim 1, wherein the acid groups in component C are of at least one type selected from among unsaturated carboxylic anhydrides, unsaturated dicarboxylic acid (including dicarboxylic acid half esters) and unsaturated carboxylic acid derivatives, with an acid content of 0.1 to 5% by weight thereof.

5. The golf ball material of claim 1, wherein component A comprises an acid content base resin having a melt flow rate of 0.1 to 10,000 g/10 min with an acid content of 0.1 to 30% by weight; wherein acids are selected from among carboxylic acids (including carboxylic anhydrides and carboxylic acid derivatives), sulfonic acids and phosphoric acids; wherein degree of neutralization is in a range of 5 to 100 mol %, and a metal cation species used as the acid neutralization is selected from among lithium, sodium, potassium, zinc, magnesium, manganese, calcium and copper; and wherein the amount of component A used depends on the amount of metal cations which transfer to and/or interact with the acid groups in a composition of components B and C.

6. The golf ball material of claim 1, wherein component B is a polybutadiene that is used itself and/or in a composition of an acid anhydride with a radical crosslinking agent to form a polybutadiene composition; and wherein by melt-mixing component A with the composition of component B and component C, followed by melt-mixing component C with a polybutadiene or its composition, metal cations in component A transfer to and/or interact with acid groups in the resin composition of components B and C.

7. The golf ball material of claim 1, wherein component B is a polybutadiene and is in a ratio of 1 to 50% by weight to the combined weight of the resin composition of component A, component B and component C.

8. A golf ball characterized by including a molding made from the golf ball material of claim 1 as defined above.

9. A golf ball characterized by use of the golf ball material of claim of 1 as defined above as a cover material in a two-piece solid golf ball composed of a core and a cover surrounding the core, or as a cover material or an intermediate cover material in a multi piece solid golf ball composed of a core of at least one layer, one or more intermediate layers surrounding the core, and a cover of at least one layer surrounding the intermediate layer.

10. A method for preparing a golf ball material having a composition of component A, component B and component C used as essential components:

(A) an ionomer, (B) a resin composition including one or more selected from the group consisting of diene polymers, thermoplastic polymers and thermoset polymers, and (C) an acid group content thermoplastic resin composition, wherein component B is a polybutadiene having a cis-1,4 bond content of at least 60%, a 1,2-vinyl bond content of at most 4%, a Mooney viscosity ($ML_{1+4}$ (100° C.)) of 35 to 65, a weight-average molecular weight (Mw) of 450,000 to 850,000, with a Mw/Mn ratio of at most 5;

the method characterized by melt-mixing component B and component C at a temperature over both melting points of components B and C to form a resin composition of components B and C, with which component A then melt-mixes wherein metal cations in component A transfer to and/or interact with at least some of the acid groups present in the resin composition of components B and C.

11. The method of claim 10, wherein a twin-screw extruder is used to melt-mix components B and C.

12. The method of claim 11, wherein the twin-screw extruder has a length-to-diameter (LD) ratio of at least 20.

13. The method of claim 11, wherein the twin-screw extruder has a screw segment configuration having a kneading disc zone in an L/D ratio of 10 to 90% to the overall L/D ratio.

14. The method of claim 11, wherein the kneading disc zone of the twin-screw extruder consist of right-handed kneading discs, left-handed kneading discs, reverse discs, and various neutral discs.

15. The method of claim 11, wherein the twin-screw extruder has a screw diameter of at least 15 mm.

16. The method of claim 11, wherein the twin-screw extruder has a vent port with a vacuum line connected thereto.

17. The method of claim 11, wherein the twin-screw extruder is equipped with a liquid-dropping apparatus or a pressurized liquid injection pump.

18. The method of claim 11, wherein the liquid is a chemical shown by the formula ROH, where R is hydrogen or an alkyl group, and is added in an amount of 0.1 to 10% by weight versus the resin extrusion output.

19. A two-piece golf ball including a core composed of a butadiene rubber-based rubber material and a cover, wherein the cover is a molding made by injection molding a golf ball material prepared by the method of claim of 10 above.

* * * * *